United States Patent [19]

Okamoto

[11] Patent Number: 4,583,506

[45] Date of Patent: Apr. 22, 1986

[54] ELECTRONICALLY CONTROLLED TYPE GOVERNOR FOR DIESEL ENGINES

[75] Inventor: Kenji Okamoto, Higashimatsuyama, Japan

[73] Assignee: Diesel Kiki Co., Ltd., Japan

[21] Appl. No.: 719,379

[22] Filed: Apr. 3, 1985

[30] Foreign Application Priority Data

Apr. 3, 1984 [JP] Japan ..... 59-65248

[51] Int. Cl.[4] ..... F02D 1/04

[52] U.S. Cl. ..... 123/357; 123/179 G

[58] Field of Search ..... 123/357, 358, 359, 196 AB, 123/179 G

[56] References Cited

U.S. PATENT DOCUMENTS 2,311,069 2/1943 Miller ..... 123/196 AB
4,377,994 3/1983 Lang ..... 123/357
4,467,762 8/1984 Fischer et al. ..... 123/359
4,499,867 2/1985 Linder et al. ..... 123/357

FOREIGN PATENT DOCUMENTS 85331 5/1983 Japan ..... 123/357
561122 5/1944 United Kingdom ..... 123/196 AB

*Primary Examiner*—Magdalen Y. C. Moy
*Attorney, Agent, or Firm*—Guy W. Shoup

[57] ABSTRACT

In an electronically controlled governor having an electronic actuator for positioning a fuel adjusting member, a warming-up current is supplied to reduce the operational resistance of the electric actuator when an auxiliary device for the starting of the diesel engine is executed, whereby the resistance due to the viscosity of the oil in the actuator is reduced by the temperature rise of the actuator caused by the warming-up current.

6 Claims, 7 Drawing Figures

ELECTRONICALLY CONTROLLED TYPE GOVERNOR FOR DIESEL ENGINES

BACKGROUND OF THE INVENTION

The present invention relates to an electronically controlled type governor for diesel engines, and more particularly to an electronically controlled type governor for diesel engines with improved low-temperature start characteristics.

In the conventional electronically controlled type governor for diesel engines like, for example, that shown in the in-line type fuel injection apparatus disclosed in Japanese Utility Model Application Disclosure No. Sho 55-130024, an actuator portion of the electronically controlled type governor is immersed in oil. Although there are also other types of electronically controlled governors that do not have the actuator portion immersed in oil, even these have their sliding portions lubricated with oil or grease.

When the actuator portion is immersed in oil or a lubricant is applied to its sliding portions, the resistance of the mechanism to mechanical operation increases with decreasing temperature because the viscosity of the oil increases at low temperature. This is disadvantageous because it makes the engine difficult to start at low temperatures.

More specifically, in the conventional electronically controlled type governor used in many fuel injection apparatuses, the fuel regulating member for regulating the amount of fuel injected is positioned at a predetermined zero injection position when the engine is stopped. Then when the starter is turned ON to crank the engine for starting, the fuel regulating member is made to move to a desired position at which the engine is supplied with the amount of fuel required for starting. Therefore, if the ambient temperature is low when the engine is to be started, the fuel regulating member sometimes does not quickly move to the desired position for starting because the higher viscosity of the oil increases the resistance to the mechanical operation. This problem is moreover aggravated by the lower terminal voltage of the battery caused by the large load current during engine starting and the poorer performance of the battery at low temperature. As a result, starting performance of the engine is remarkably degraded.

SUMMARY OF THE INVENTION

It is an object of the present invention to provide an improved electronically controlled type governor for diesel engines which is free from the drawbacks mentioned above.

It is another object of the present invention to provide an electronically controlled type governor for diesel engines in which engine starting performance is not impaired at low temperatures.

According to the present invention, in an electronically controlled type governor for diesel engines, the governor comprises an electronic actuator for adjusting the position of a fuel adjusting member of a fuel injection pump, means for producing a preheating signal indicating the execution of an auxiliary device for the starting of the diesel engine, means responsive to at least one condition signal for producing a first target signal indicating the position of the fuel adjusting member necessary for obtaining the optimum amount of fuel injection, means for producing a second target signal for the warming-up operation of the electric actuator, a selecting means responsive to the preheating signal for selecting either the first or second target signal, the second target signal being selected when the preheating operation is carried out by the auxiliary device and the first target signal being selected when the preheating operation has been terminated, and an output means responsive to the output from the selecting means for producing a driving signal for the electric actuator.

The "auxiliary device" may, for example, be a glow plug preheating device, an in-take air preheating device or the like. As the signal for the warming-up operation there can be supplied to the coil of the actuator a level of actuator driving current such that the fuel regulating member assumes a predetermined position.

Furthermore, the current may be supplied to the actuator coil in the form of a pulsating flow so that the actuator is not only warmed but also made to vibrate together with its associated members. With this construction, since the resistance due to the viscosity of the oil in the actuator, oil attached to the link mechanism and the like is reduced within a relatively short period both by the vibration of the actuator and the associated members and by the temperature rise of the actuator caused by the pulsating current, a remarkable improvement in the starting performance of the engine can be realized.

The present invention will be better understood and the other objects and advantages thereof will be more apparent from the following detailed description of perferred embodiments with reference to the accompanying drawings.

DESCRIPTION OF THE PREFERRED EMBODIMENTS

Figure 1:
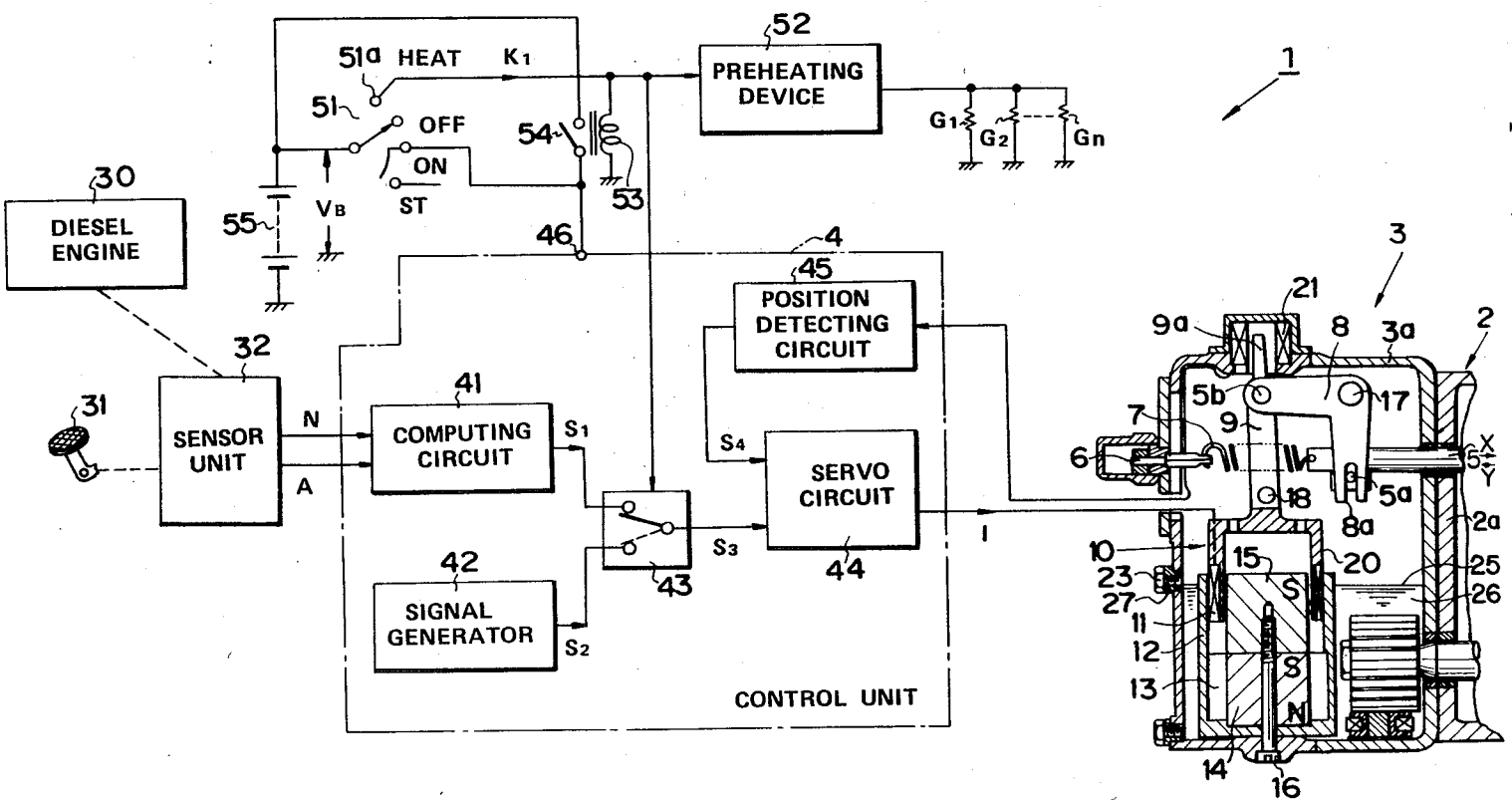
FIG. 1 is a block diagram showing the control system of an embodiment of an electronically controlled type governor according to the present invention including a sectional view of an actuator unit.

FIG. 1 shows an embodiment of an electronically controlled type governor according to the present invention. The electronically controlled type governor 1 has an actuator unit 3 for adjusting the position of a fuel adjusting rod 5 provided on a fuel injection pump 2 for adjusting the amount of fuel injected to a diesel engine, and a control unit 4 for electronically controlling the actuator unit 3.

The case 3*a* of the actuator unit 3 is fixed to the case 2*a* of the fuel injection pump 2 and the fuel adjusting rod 5 of the fuel injection pump 2 projects inside the case 3*a*. A return spring 7 is provided between the free end portion of the fuel adjusting rod 5 and an adjusting bolt 6 supported on the wall of the case 3*a*, and a pin 5*a* secured on the fuel adjusting rod 5 is engaged with a recess 8*a* defined at the end portion of a bell-crank 8. The bell-crank 8 is rotatably supported on the case 3*a* by means of a supporting shaft 17 and another end portion of the bell-crank 8 is connected with a link 9 by a pin 5*b*. The link 9 is connected with a cylindrical movable member 20 of a solenoid actuator 10 by means of a pin 18.

The solenoid actuator 10 has a cylindrical member 12 with a bottom wall made of a magnetic material and a columnar permanent magnet 14 which is magnetized along its axis as shown in FIG. 1. The columnar permanent magnet 14 is placed in such a way that the end surface thereof magnetized in N polarity is in contact with the bottom wall of the cylindrical member 12 and a magnetic member 15 of the same diameter as that of the columnar permanent magnet 14 is provided on the end face magnetized in S polarity of the columnar permanent magnet 14. The cylindrical 12, the columnar permanent magnet 14 and the magnetic member 15 are secured to the case 3*a* by a bolt 16 to define an annular space 13 between the cylindrical member 12 and the assembly of the columnar permanent magnet 14 and the magnetic member 15. A coil 11 is provided at the lower end portion of the movable member 20 in the annular space 13, whereby the movable member 20 is permitted to move along its axis in the annular space 13.

The tip 9*a* of the link 9 is inserted into a detecting coil 21 secured on the upper wall of the case 3*a* for detecting the amount of operation of the solenoid actuator 10.

As described above, the stator of the solenoid actuator 10 is secured to the bottom wall of the case 3*a* and the movable member 20 moves up or down in response to the current level supplied to the coil 11. The movement of the movable member 20 is transmitted through the bell-crank 8 to the fuel adjusting rod 5.

In order to provide appropriate clamping of the movement of the movable member 20, the lower portion of the case 3*a*, which has an oil tight structure, is filled with a lubricant 26 to such a level that the cylindrical member 12 is substantially below the surface level 25 of the lubricant 26.

Furthermore, to maintain the surface level 25 at a predetermined height, there is provided a drain port 27 which is closed by a screw plug 23 on the side wall of the case 3*a* so that excess oil can be taken out via the drain port 27 at any time.

In this embodiment, the movable member 20 moves downward to move the fuel adjusting rod 5 in the direction indicated by arrow X for increasing the amount of fuel injected as the level of the driving current supplied to the coil 11 increases, while the movable member 20 moves upward to move the fuel adjusting rod 5 in the opposite direction indicated by arrow Y for decreasing the amount of fuel injected as the level of the driving current supplied to the coil 11 decreases.

An explanation will now be made on the control unit 4. The control unit 4 has a computing circuit 41 to which a speed signal N showing the engine speed of a diesel engine 30 associated with the fuel injection pump 2 and an acceleration signal A showing the amount of depression of an accelerator pedal 31 are applied from a sensor unit 32. The computing circuit 41 computes the optimum amount of fuel injection for the operating condition of the diesel engine 30 on the basis of the speed signal N and the acceleration signal A and produces a first target signal $S_1$ representing the target position of the fuel adjusting rod 5 for obtaining the computed optimum amount of fuel injected. The control unit 4 further comprises a signal generator 42 for producing a second target signal $S_2$ representing a target position of the fuel adjusting rod 5 which is slightly short of the maximum position during normal operation of the diesel engine.

The first and second target signals $S_1$ and $S_2$ are applied to a selecting switch 43 which is controlled in response to a preheating command signal $K_1$ from an ignition switch 51 which will be described hereinafter, and the one target signal selected by the selecting switch 43 is applied as a servo target signal $S_3$ to a servo circuit 44. A position signal $S_4$ showing the actual position of the fuel adjusting rod 5 at each instant is applied to the servo circuit 44 as a feedback signal from a position detecting circuit 45 connected with the detecting coil 21. In response to the servo target signal $S_3$ and the position signal $S_4$, the servo circuit 44 supplies to the coil 11 of the solenoid actuator 10 a driving current I of the required level for positioning the fuel adjusting rod 5 at the position shown by the servo target signal $S_3$.

Consequently, when the selecting switch 43 is switched over as shown by the solid line, the control unit 4 is in a speed control mode, in which the amount of fuel injected from the fuel injection pump 2 is controlled so as to become a desired optimum value according to the condition of the operation of the diesel engine 30 at each instant, whereby the speed of the diesel engine 30 is controlled in accordance with a predetermined governor speed characteristic. On the other hand, when the selecting switch 43 is switched over as shown by the broken line, the control unit 4 is in a warming-up mode in which the driving current I is supplied at a level which causes the fuel adjusting rod 5 to assume the position slightly short of the maximum position during normal operation of the diesel engine represented by the second target signal $S_2$ so that the actuator unit 3 is warmed by this driving current.

The ignition switch 51 has an "OFF" position, an "ON" position, an "ST" position for cranking the diesel engine 30, and a "HEAT" position for producing the preheating command signal $K_1$ which actuates a preheating device 52 for heating glow plugs $G_1$, $G_2$, . . . $G_n$ mounted on the diesel engine 30 and switches the control unit 4 over to the warming-up mode described above. A relay coil 53 is connected between earth and the fixed contact 51*a* corresponding to the "HEAT" position of the ignition switch 51.

Therefore, when the ignition switch 51 is switched over to the "HEAT" position to produce the preheating command signal $K_1$, the preheating device 52 operates to start the preheating operation of the glow plugs $G_1$, $G_2$, . . . $G_n$ and at the same time a relay switch 54 associated with the relay coil 53 is closed to supply electric power from a battery 55 to a power input terminal 46 of the control unit 4. Furthermore, the preheating command signal $K_1$ is also applied to the selecting switch 43 to switch it over to the state shown by the broken line. Therefore, the control unit 4 supplies the actuator 10 with driving current I of the level determined by the second target signal $S_2$ during the preheating operation of the glow plugs $G_1$ to $G_n$.

Figure 2A:
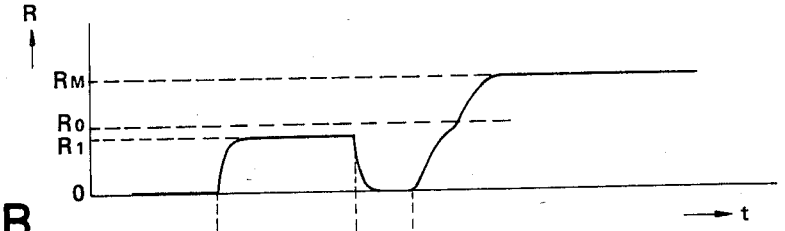
FIGS. 2A to 2B are graphs showing the change in the position of the fuel adjusting rod and the terminal voltage of the battery in FIG. 1, respectively.
Figure 2B:
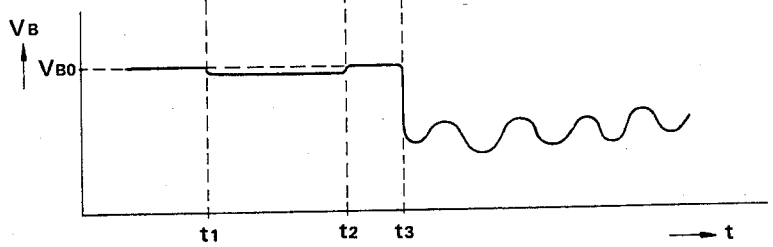

FIGS. 2A and 2B show how the position R of the fuel adjusting rod 5 and the terminal voltage $V_B$ of the battery 55 vary over time in response to the operation of the ignition switch 51. When the ignition switch 51 is switched to the "HEAT" position at $t_1$, the warming-up current starts to flow through the coil 11 of the actuator 10 simultaneously with the start of the heating of the glow plugs $G_1$ to $G_n$ and the fuel adjusting rod 5 assumes a predetermined position $R_1$ slightly below the boundary position $R_0$. At this time, the terminal voltage $V_B$ decreases only slightly, so that the driving operation for positioning the fuel adjusting rod 5 can be carried out at approximately the full (nominal) level of terminal voltage. As a result, the fuel adjusting rod 5 is moved to the position $R_1$ with relatively high response speed. The heating of the glow plugs is carried out till time $t_2$, and during this period, the current flowing through the coil 11 warms the oil in the actuator 10 and that attached to members in the vicinity thereof, thus reducing the operational resistance of the driving system for the fuel adjusting rod 5 including the actuator 10.

When the ignition switch 51 is switched to the "OFF" position at $t_2$, the fuel adjusting rod 5 returns to its predetermined original position (R=0) and the value of the terminal voltage $V_B$ becomes equal to the nominal value $V_{B0}$. After this, when the ignition switch 51 is switched to the "ST" position at $t_3$, the cranking operation of the diesel engine 30 is carried out. At this time, the production of the preheating command signal $K_1$ has already terminated, so that the control state of the control unit 4 has been switched to the speed control mode. In this case, the actuator 10 is controlled by the control unit 4 so as to position the fuel adjusting rod 5 at a predetermined position $R_M$ at which an increased amount of fuel injection for starting operation is provided.

Since a starter motor (not shown) is driven at this time, the terminal voltage $V_B$ is pronouncedly lowered, so that the response speed for the positioning operation of the fuel adjusting rod 5 by the actuator 10 is lowered. However, the fuel adjusting rod 5 is relatively quickly positioned at the desired position $R_M$ in response to the engine start operation at $t_3$ because the oil in the actuator 10 has been ejected by the movement of the movable member 20 for positioning the fuel adjusting rod 5 to the position $R_0$ during the warming-up mode and the viscosity of the oil in the actuator 10 and attached to members in the vicinity thereof has been lowered by the warming of the oil during the warming-up mode.

As a result, even when the ambient termperature is low, the fuel adjusting rod 5 can be relatively quickly located at the required position for providing the increased amount of fuel injection for the engine start operation at the time of engine cranking, so that the starting performance at low temperature can be remarkably improved.

Although the foregoing description relates to an embodiment of the electronically controlled type governor using an actuator unit in which the solenoid actuator is immersed in oil, the present invention is not limited to such an embodiment. It is also applicable to other types of fuel injection apparatuses in a similar way and with a similar effect of improving starting performance by reducing the viscosity of oil attached to link mechanisms and the like.

Furthermore, the control unit 4 may be constituted by the use of a microcomputer or microprocessor. In this case, the function of the control unit 4 of FIG. 1 can be easily realized by adding to the conventional governor control program a program in which discrimination is made as to whether the preheating command signal $K_1$ has been produced and a control signal for positioning the fuel adjusting rod 5 at the position $R_0$ (See FIG. 2A) is produced instead of the usual control data only when the production of the preheating command signal $K_1$ is detected.

With the construction shown in FIG. 1, since the warming-up current is supplied to the solenoid actuator prior to the cranking operation of the engine to warm the actuator unit and reduce the viscosity of the oil therein, it is possible to reduce the operating resistance of the actuator unit during cranking. As a result, the low-temperature starting performance of the diesel engine can be remarkably improved.

Figure 3:
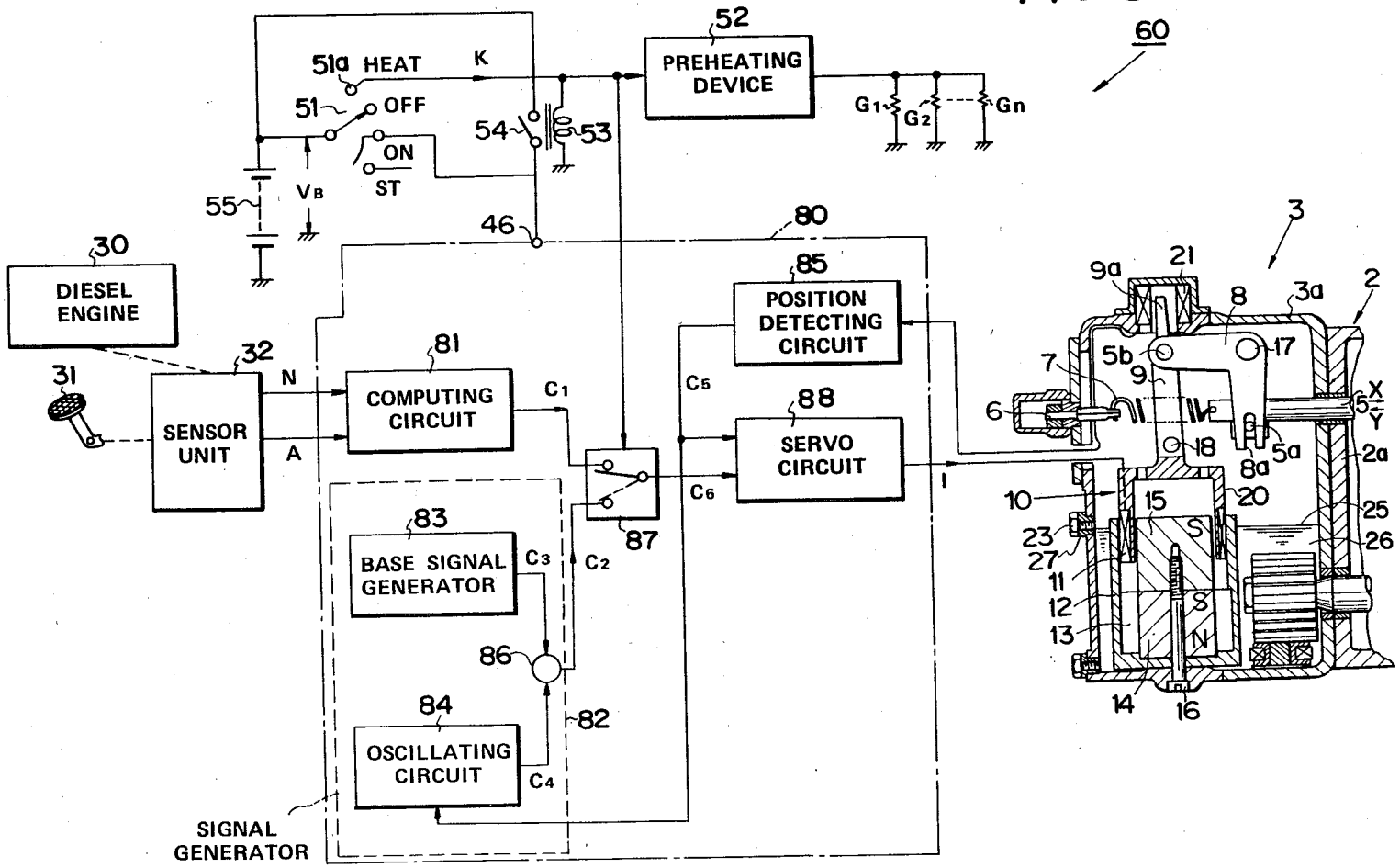
FIG. 3 is a block diagram showing the control system of another embodiment of an electronically controlled type governor according to the present invention including a sectional view of an actuator unit.

FIG. 3 shows another embodiment of the electronically controlled type governor for diesel engines according to the present invention. The electronically controlled type governor 60 of FIG. 3 is different from that shown in FIG. 1 in that it is provided with a control unit 80 instead of the control unit 4. In FIG. 3, since the construction of the governor 60 is the same as that of the governor 1 shown in FIG. 1 except for the construction of the control unit 80, the same reference numbers as those in FIG. 1 are given to the portions corresponding to those in FIG. 1 and the description thereof will be omitted.

The control circuit 80 has a computing circuit 81 to which the speed signal N and the acceleration signal A are applied from the sensor unit 32. The computing circuit 81 computes the optimum amount of fuel injection for the operating condition of the diesel engine 30 on the basis of the speed signal N and the acceleration signal A and produces a first target signal $C_1$ representing the target position of the fuel adjusting rod 5 for obtaining the computed optimum amount of fuel injection. The control unit 80 further comprises a signal generator 82 for producing a second target signal $C_2$ for vibrating the fuel adjusting rod 5 with a predetermined amplitude at a position just short of that represented by $R_0$ in FIG. 4A.

The signal generator 82 has a base signal generator 83 for producing a base position signal $C_3$ representing a predetermined base position $R_1$ which is below but close to the position $R_0$ and an oscillating circuit 84 for producing an a.c. signal $C_4$ to be superposed on the base position signal $C_3$ for the purpose of making the fuel adjusting rod 5 vibrate with the predetermined amplitude at the position $R_1$. A position signal $C_5$ showing the actual position of the fuel adjusting rod 5 at each instant is applied from a position detecting circuit 85 connected with the detecting coil 21 to the oscillating circuit 84, and the oscillating circuit 84 is constituted so as to produce the a.c. signal $C_4$ when it is detected from the position signal $C_5$ the fuel adjusting rod 5 has reached the position $R_2$ just before the position $R_1$. The a.c. signal $C_4$ produced as described above is added to the base position signal $C_3$ by an adder 86 and the resulting signal from the adder 86 is derived as the second target signal $C_2$. The amplitude level of the a.c. signal $C_4$ and the level of the base position signal $C_3$ are set in such a way that the position of the fuel adjusting rod 5 never exceeds the maximum position $R_0$ for the normal control state (See FIG. 4A) even when the level of the second target signal C reaches its maximum level. Furthermore, the period of the a.c. signal $C_4$ is set taking account of the response characteristics of the solenoid actuator 10 in such a way that the solenoid actuator 10 is able to operate in accordance with the level change in the a.c. signal $C_4$.

The first and second target signals $C_1$ and $C_2$ are applied to a selecting switch 87 which is controlled in response to the preheating command signal $K_1$ from the ignition switch 51, and the one target signal selected by the selecting switch 87 is applied as a servo target signal $C_6$ to a servo circuit 88. The position signal $C_5$ is applied as a feedback signal from the position detecting circuit 85 to the servo circuit 88 and, in response to the servo target signal $C_6$ and the position signal $C_5$, the servo circuit 88 supplies to the coil 11 of the solenoid actuator 10 a driving current I of the required level for positioning the fuel adjusting rod 5 at the position shown by the servo target signal $C_6$.

Consequently, when the selecting switch 87 is switched over as shown by the broken line in response to the preheating command signal $K_1$ at the start of the preheating operation, the control unit 80 is switched over to the warming-up mode. In the warming-up mode, since the driving current I is supplied as the warming-up current to the coil 11 in accordance with the second target signal $C_2$, the fuel adjusting rod 5 is vibrated in accordance with the a.c. signal $C_4$ at the position $R_1$ determined by the base position signal $C_3$. As a result, the solenoid actuator 10 is vibrated at a predetermined frequency to soften the oil in the actuator unit 3. Moreover, the actuator unit 3 is warmed by the driving current to reduce the viscosity of the oil.

On the other hand, after the termination of the heating of the glow plugs, when the selecting switch 87 is switched over as shown by the solid line, the control unit is switched to the speed control mode, in which the amount of fuel injected from the fuel injection pump 2 is controlled so as to become a desired optimum value for the operating condition of the diesel engine 30 at each instant and the speed of the diesel engine 30 is controlled in accordance with a predetermined governor speed characteristic.

The operation of the electronically controlled type governor 60 will now be described in conjunction with FIGS. 3 and 4.

Figure 4A:
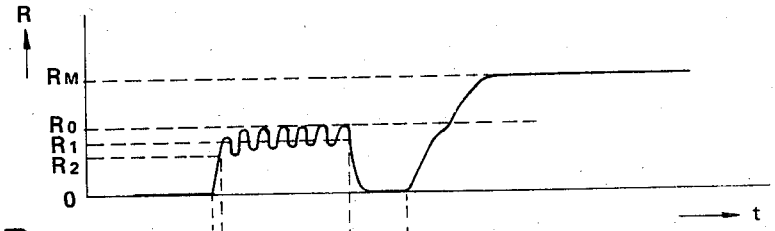
FIGS. 4A and 4B are graphs showing the change in the position of the fuel adjusting rod and the terminal voltage of the battery in FIG. 3, respectively.
Figure 4B:
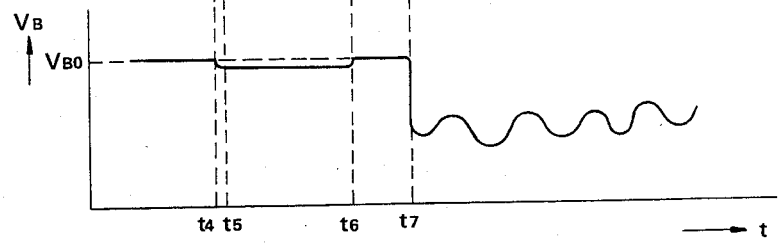

FIGS. 4A and 4B show how the position R of the fuel adjusting rod 5 and the terminal voltage $V_B$ of the battery 55 vary over time in response to the operation of the ignition switch 51. When the ignition switch 51 is switched to the "HEAT" position at $t_4$, the warming-up current starts to flow through the coil 11 of the actuator 10 simultaneously with the start of the preheating operation of the glow plugs $G_1$ to $G_n$. At this time, the position R of the fuel adjusting rod 5 is controlled in accordance with the second target signal $C_2$ from the signal generator 82. Therefore, at first, the fuel adjusting rod 5 moves in the direction for increasing the amount of fuel injection in accordance with the base position signal $C_3$. Then, when $R=R_2$ at time $t_5$ the oscillating circuit 84 operates to produce the a.c. signal $C_4$, which is superposed on the base position signal $C_3$.

As a result, the fuel adjusting rod 5 vibrates at the predetermined frequency at the position $R_1$ after time $t_5$. However, the position R never exceeds the position $R_0$. In this case, the terminal voltage $V_B$ decreases only slightly, so that the driving operation for positioning the fuel adjusting rod 5 can be carried out with approximately the nominal level of terminal voltage. As a result, the fuel adjusting rod 5 vibrates about the position $R_1$ with relatively high response speed. The preheating operation (heating of the glow plugs) is carried out till time $t_5$, and during this period, the vibrating operation of the actuator 10 caused by the current flowing through the coil 11 softens the oil in the actuator 10 and attached to members in the vicinity thereof, thereby reducing the operational resistance of the driving system for the fuel adjusting rod 5 including the actuator 10. Furthermore, the oil is also softened and reduced in viscosity by heat generated by the driving current I.

When the ignition switch 51 is switched to the "OFF" position at $t_6$, the fuel adjusting rod 5 is returned to the predetermined original position ($R=0$) and the terminal voltage $V_B$ becomes equal to the nominal value $V_{B0}$. After this, when the ignition switch 51 is switched to the "ST" position at $t_7$, the cranking operation of the diesel engine 30 is carried out. At this time, the production of the preheating command signal $K_1$ has already terminated, so that the control unit 4 has been switched to the speed control mode. In this mode, the actuator 10 is controlled by the control unit 4 so as to position the fuel adjusting rod 5 at a predetermined position $R_M$ where an increased amount of fuel injection for starting operation can be provided.

Since a starter motor (not shown) is driven at this time, the terminal voltage $V_B$ is pronouncedly lowered, so that the response speed for the positioning operation of the full adjusting rod 5 by the actuator 10 is lowered. However, the fuel adjusting rod 5 is relatively quickly positioned at the desired position $R_M$ in response to the engine start operation at t because the oil in the actuator 10 has been ejected by the movement of the movable member 20 for positioning the fuel adjusting rod 5 to the position $R_0$ during the warming-up mode and the viscosity of the oil in the actuator 10 and attached to members in the vicinity thereof has been lowered by the warming of the oil during the warming-up mode.

As a result, even when the ambient temperature is low, the fuel adjusting rod 5 can be relatively quickly located at the required position for providing the increased amount of fuel injection for the engine start operation at the time of engine cranking, so that the starting performance at low temperature can be remarkably improved.

The foregoing description relates to an embodiment in which the actuator 10 is made to vibrate by the a.c. signal $C_4$ from the oscillating circuit 84. However, the waveform of the a.c. signal $C_4$ is not limited to a sinusoidal wave, and a square wave or any other wave capable of periodically changing the position of the fuel adjusting rod 5 may be used instead.

Figure 5:
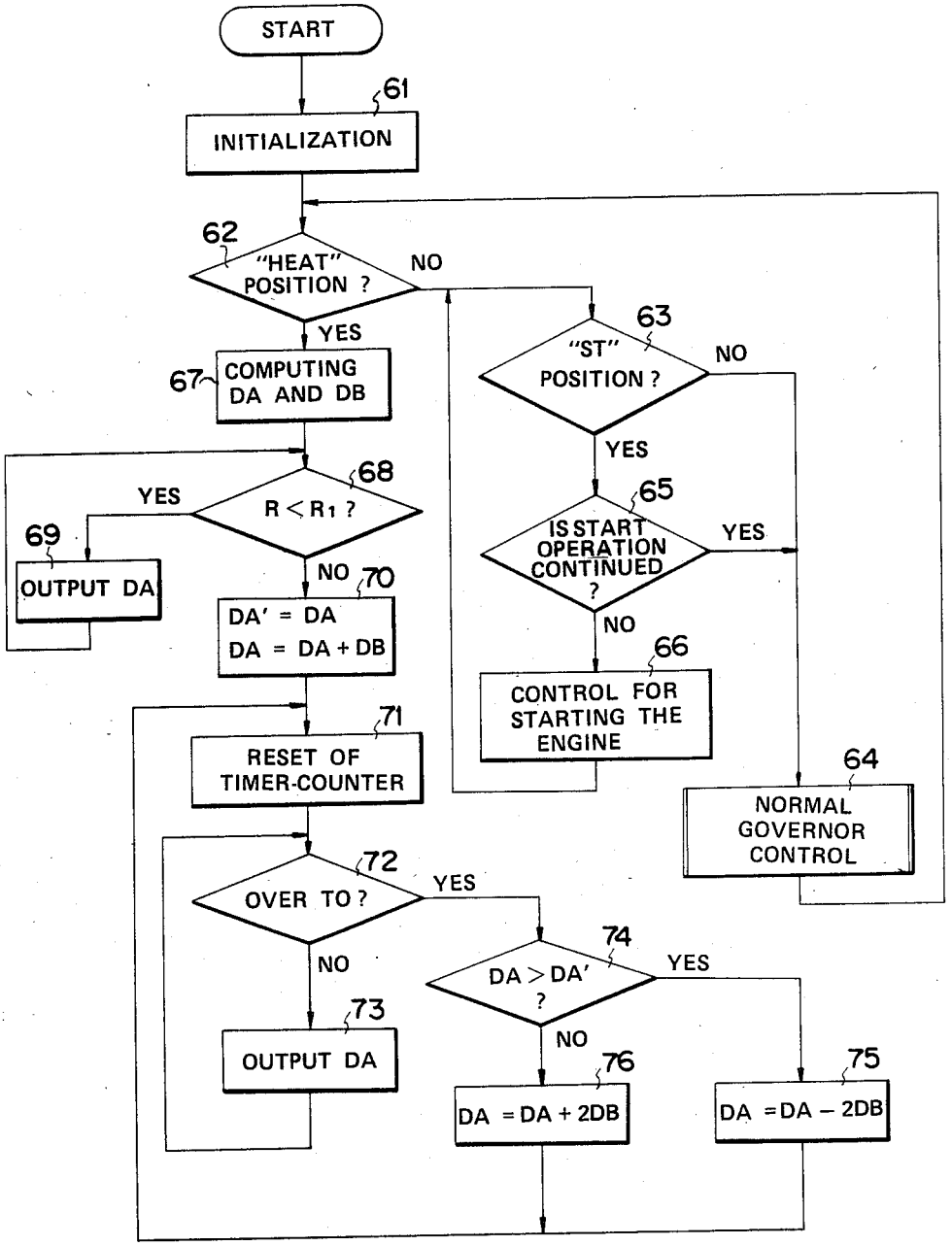
FIG. 5 is a flowchart showing a control program to be executed by a microcomputer for obtaining the same function as that of the control unit shown in FIG. 3 when the control unit shown in FIG. 3 is constituted by the use of a microcomputer.

FIG. 5 shows a flowchart representing one example of a control program to be executed by a microcomputer when functions similar to those of the control unit 80 are to be realized by the use of a microcomputer.

The execution of the control program shown in FIG. 5 starts when the power switch (not shown) of the control unit 80 is turned ON to cause an initializing operation to be executed in step 61. After this, the operation moves to step 62 in which discrimination is made as to whether the ignition switch 51 is switched to the "HEAT" position If the result in step 62 is NO, a decision is made in step 63 as to whether the ignition switch 51 is switched to the "START" position. When the decision in step 63 is NO, the ignition switch 51 is determined to be switched to the "ON" position, so that the operation moves to step 64 where normal governor speed control is executed. The normal governor speed control executed in step 64 corresponds to the governor control carried out by the positional control of the fuel adjusting rod 5 according to the first target signal $C_1$ as described in conjunction with FIG. 3. After the execution of step 64, the operation reverts to step 62.

When the decision in step 63 is YES, a decision is made as to whether predetermined conditions for releasing the starting operation of the engine are satisfied. (Such conditions may include, for example, that the engine speed has reached more than a predetermined value.) When the predetermined conditions for releasing the starting operation are satisfied, the operation moves to step 64 where the normal governor speed control is carried out. On the other hand, when the decision in step 65 is NO, the operation moves to step 66 where the fuel adjusting rod 5 is maintained at the position $R_M$ for supplying the amount of fuel required for starting the engine, and the operation reverts to step 63.

When the ignition switch 51 is at the "HEAT" position, the decision in step 62 is YES, and the operation moves to step 67 where data DA representing the level of the actuator driving current required for obtaining the condition $R=R_1$ and data DB representing the amount of variation in the driving current required for vibrating the fuel adjusting rod 5 with a predetermined amplitude are computed. Next, a decision is made in step 68 as to whether the value of R representing the position of the fuel adjusting rod 5 is less than $R_1$ and data DA is output in step 69 to provide the driving current based on data DA when the decision in step 68 is YES. Thus, the fuel adjusting rod 5 moves so as to increase the amount of fuel injection and the operation moves to step 70 when $R=R_1$.

In step 70, after data DA is stored as data DA', data DB is added to data DA and the resulting data is stored as data DA. The operation then moves to step 71 where a timer-counter is reset and a decision is made in step 72 as to whether the oscillating period $T_0$ has passed. The oscillating period $T_0$ corresponds to the period of the a.c. signal $C_4$ in FIG. 3 and the operation moves to step 73 where data DA is output when the decision in step 72 is NO.

As a result, the position R moves beyond the position $R_1$ by a distance determined by data DB. However, the position R never exceeds the position $R_0$. This condition is continued till the decision in step 72 becomes YES upon the passage of the oscillating period $T_0$.

When the decision in step 72 becomes YES, it is decided in step 74 whether the position R is next to be shifted beyond the position $R_1$ by the distance shown by the data DB. When the condition of $DA>DA'$ is decided in step 74, since it follows that the position R is shifted above the position $R_1$ by the distance shown by data DB, the operation moves to step 75 where the data DA is replaced by data $DA-2DB$. On the other hand, when the condition of $DA\leqq DA'$ is decided in step 74, since it follows that the position R is shifted below the position $R_1$ by the distance shown by data DB, the operation moves to step 76 where the data DA is replaced by data $DA+2DB$. Thus, after the renewal data DA is set in step 75 or 76, the operation reverts to step 71 and moves through step 72 to step 73.

As a result, when the position R is shifted above the position $R_1$ by the distance corresponding to data DB, the driving current of the actuator 10 is changed so as to shift the position R below the position $R_1$ by the distance corresponding to data DB. On the other hand, the driving current of the actuator 10 is changed so as to shift the position R above the position $R_1$ by the distance corresponding to data DB, when the position R is shifted below the position $R_1$.

That is, the position R is alternately shifted in the increasing/decreasing direction about $R_1$ by the distance corresponding to the data DB, whereby the fuel adjusting rod 5 is vibrated. The vibrating operation of the fuel adjusting rod 5 is continued till the ignition switch 51 is switched to a position other than the "HEAT" position.

When the ignition switch 51 is switched from the "HEAT" position through the "OFF" position to the "ON" or "ST" position, since the power supply to the control unit 60 is temporarily cut off at the "OFF" position, the program is started again, and the control operation for starting the engine or the normal governor speed control operation is carried out through steps 61 and 62.

I claim:

1. An electronically controlled type governor for diesel engines, said governor comprising:

an electric actuator for adjusting the position of a fuel adjusting member of a fuel injection pump;

means for producing a preheating signal indicating the execution of a preheating operation by an auxiliary device for the starting of the diesel engine;

means responsive to at least one condition signal for producing a first target signal indicating the position of said fuel adjusting member necessary for obtaining the optimum amount of fuel injection;

means for producing a second target signal for the warming-up operation of said electric actuator;

a selecting means responsive to the preheating signal for selecting either said first or second target signal, said second target signal being selected when said preheating operation is carried out by said auxiliary device and said first target signal being selected when the preheating operation has been terminated; and an output means responsive to the output from said selecting means for producing a driving signal for said electric actuator.

2. A governor as claimed in claim 1 wherein said output means has means for producing a position signal indicating the position of said fuel adjusting member at each instant, and a servo means responsive to the output from said selecting means and said position signal for positioning said fuel adjusting member at the position designated by the signal selected by said selecting means.

3. A governor as claimed in claim 2 wherein said electric actuator is driven by the driving signal so as to maintain the position of said fuel adjusting member at a predetermined fixed position during the preheating operation, whereby said actuator is warmed by the driving signal.

4. A governor as claimed in claim 1 wherein said means for producing the second target signal has means for producing a first signal indicating the base position of said fuel adjusting member, means for producing a second signal whose level periodically varies, and means for superposing the second signal on the first signal to produce said second target signal, whereby said fuel adjusting member is vibrated at the position indicated by said first signal.

5. A governor as claimed in claim 4 wherein the second signal is a sinusoidal signal.

6. A governor as claimed in claim 4 wherein the levels of said first and said second signals are set in such a way that the level of the second target signal obtained by superposing said second signal on said first signal does not exceed the level representing the maximum position of said fuel adjusting member in normal control operation.

* * * * *